US006863484B2

(12) United States Patent
Sridhar

(10) Patent No.: US 6,863,484 B2
(45) Date of Patent: Mar. 8, 2005

(54) CATAMARAN TRANSFER VESSEL

(75) Inventor: Sidney Sridhar, Richmond (CA)

(73) Assignee: Seabulk Systems Inc., Richmond (CA)

( * ) Notice: Subject to any disclaimer, the term of this patent is extended or adjusted under 35 U.S.C. 154(b) by 213 days.

(21) Appl. No.: 10/147,035

(22) Filed: May 17, 2002

(65) Prior Publication Data

US 2003/0215310 A1 Nov. 20, 2003

(51) Int. Cl.[7] ..... B63B 27/22
(52) U.S. Cl. ..... 414/138.5; 414/138.8
(58) Field of Search ..... 414/138.5, 138.6, 414/138.8; 212/307, 309

(56) References Cited

U.S. PATENT DOCUMENTS 4,465,012 A * 8/1984 Bos ..... 114/266
6,010,295 A * 1/2000 Sridhar ..... 414/138.6 X

* cited by examiner

*Primary Examiner*—Donald W. Underwood
(74) *Attorney, Agent, or Firm*—Elbie R. de Kock

(57) ABSTRACT

A transshipper for floating on water comprises a pair of elongate buoyant vessels arranged in parallel spaced relationship for receiving a feeder barge to be unloaded between the vessels. The platform is supported by the buoyant vessels in a raised position above the buoyant vessels. A transfer conveyor supported by the buoyant vessels extends transversely of the buoyant vessels in a raised position above the buoyant vessels. A first lifting conveyor is suspended from the platform and is movable longitudinally of the transfer conveyor for raising material to be unloaded from a feeder barge located between the buoyant vessels and for depositing the material onto the transfer conveyor. A second lifting conveyor is provided for receiving material from the transfer conveyor and an unloading boom is provided for receiving the material from the second lifting conveyor and for delivering the material to a receiving vessel located alongside one of the buoyant vessels.

6 Claims, 7 Drawing Sheets

CATAMARAN TRANSFER VESSEL

FIELD OF THE INVENTION

This invention relates to a catamaran transfer vessel for the transfer of cargo from a barge or barges into a Cape or Panamax size vessel.

BACKGROUND OF THE INVENTION

It is a problem with harbours without deep water docking facilities that large cargo ships cannot be accommodated. One solution to this problem is to load cargo into a lighter barge which then travels out to deep water and is anchored alongside the cargo ship. Use is then made of a floating structure for the transfer of cargo from the barge to the cargo ship.

Mid-stream transhipment faces the challenge of maintaining the most efficient and continuous transfer of material in open sea.

SUMMARY OF THE INVENTION

According to the invention there is provided a transshipper for floating on water, comprising a pair of elongate buoyant vessels arranged in parallel spaced relationship for receiving a feeder barge to be unloaded between the vessels; a platform supported by the buoyant vessels in a raised position above the buoyant vessels; a transfer conveyor supported by the buoyant vessels extending transversely of the buoyant vessels in a raised position above the buoyant vessels; a first lifting conveyor suspended from the platform and movable longitudinally of the transfer conveyor for raising material to be unloaded from a feeder barge located between the buoyant vessels and depositing said material onto the transfer conveyor; a second lifting conveyor for receiving the material from the transfer conveyor; and an unloading boom for receiving the material from the second lifting conveyor and for delivering said material to a receiving vessel located alongside one of said buoyant vessels.

Further objects and advantages of the invention will become apparent from the description of preferred embodiments of the invention below.

BRIEF DESCRIPTION OF THE DRAWINGS

The invention will now be described, by way of examples, with reference to the accompanying drawings, in which.

DETAILED DESCRIPTION OF THE PREFERRED EMBODIMENTS

Figure 1:
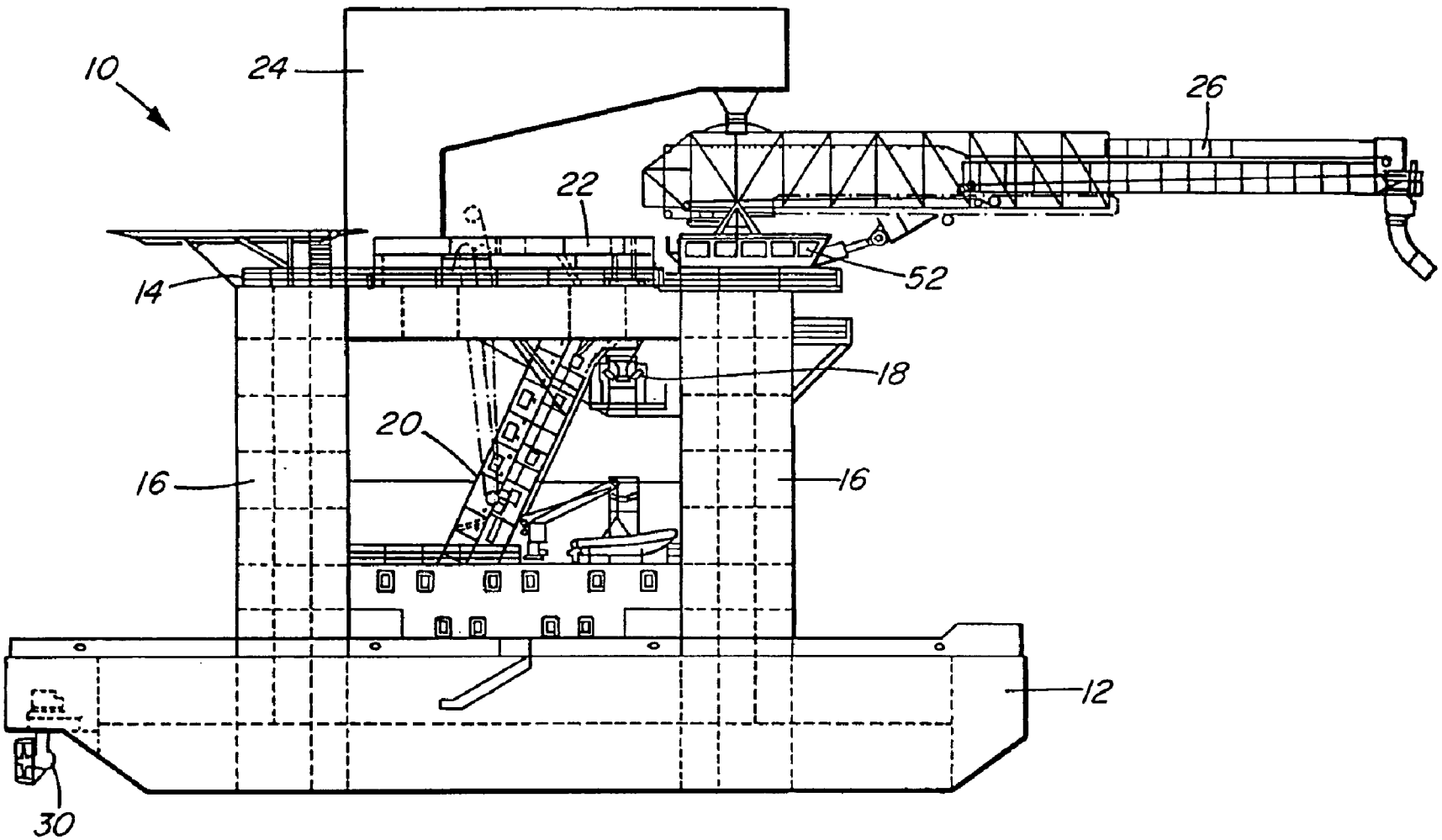
FIG. 1 is a side view of a transshipper in the form of a catamaran transfer vessel.

In the drawings, reference numeral 10 generally indicates a catamaran transfer vessel comprising a pair of elongate buoyant vessels or pontoons 12, an upper platform deck 14 supported in a raised position above the pontoons 12 by means of four columns 16. A transfer conveyor 18 extends transversely of the pontoons 12 from one side of the vessel 10 to the other.

A first lifting conveyor, in the form of a bucket elevator 20, is suspended from a trolley 22 which runs on gantry beams extending transversely of the pontoons 12 so that the bucket elevator 20 is capable of translational movement from one side of the vessel 10 to the other.

The bucket elevator 20 comprises a pair of laterally spaced endless chains mounted for rotation about sprockets with a plurality of buckets mounted between the chains, as described in U.S. Pat. No. 6,010,295, the entire contents of which is incorporated herein by reference. Hereafter, the bucket elevator 20 will conveniently be referred to as "marine leg 20".

Figure 2:
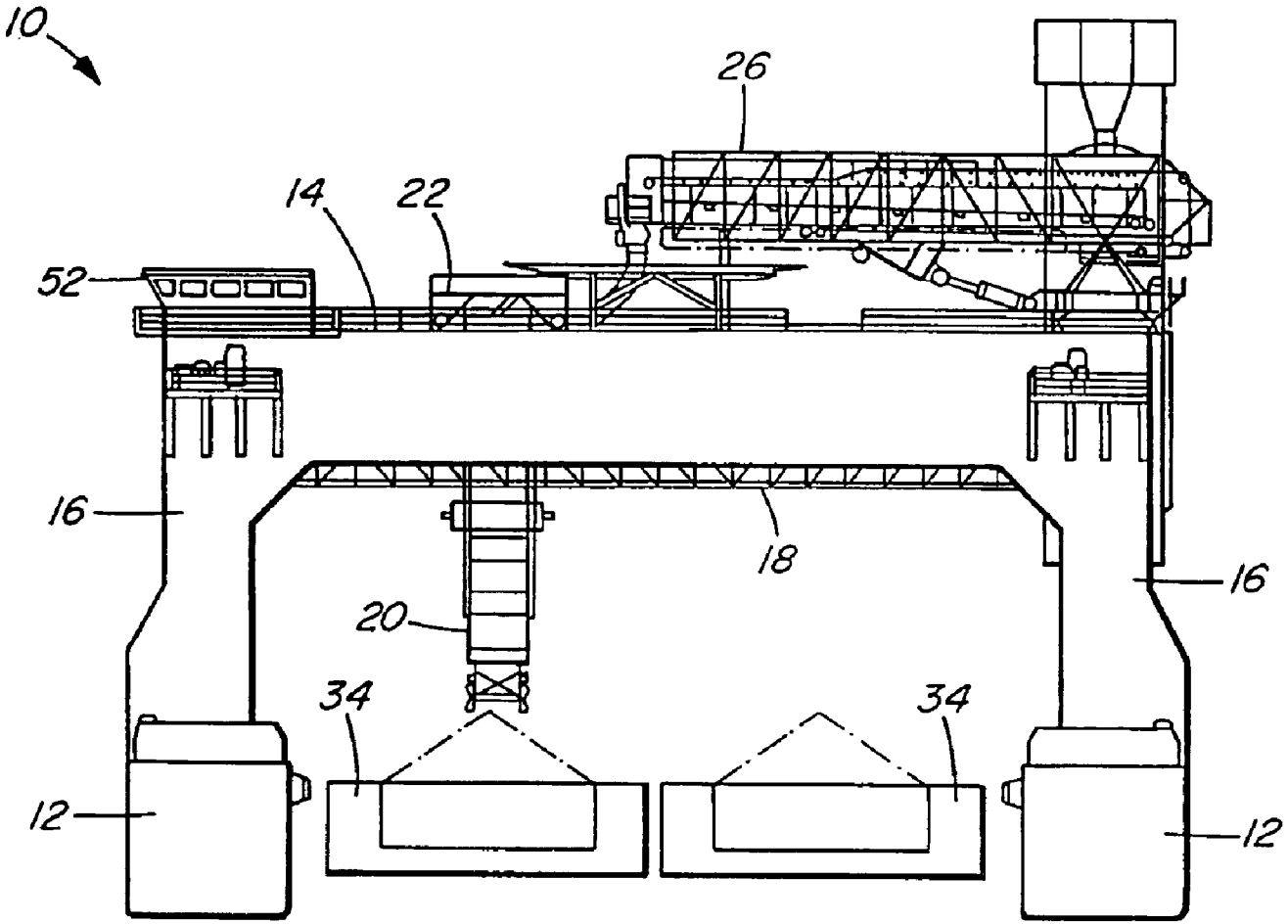
FIG. 2 is an end view of the vessel of FIG. 1.
Figure 3:
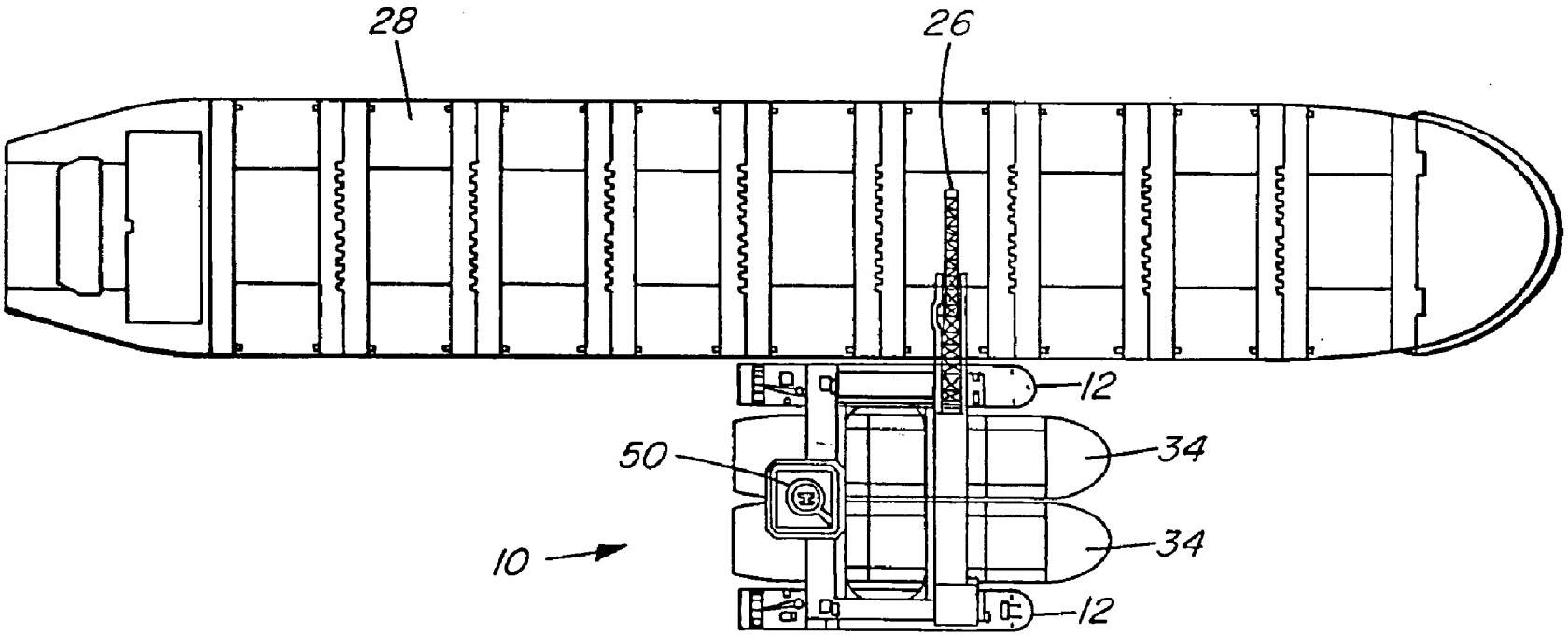
FIG. 3 is a plan view of the vessel of FIG. 1 shown in position alongside a Cape size vessel.
Figure 4:
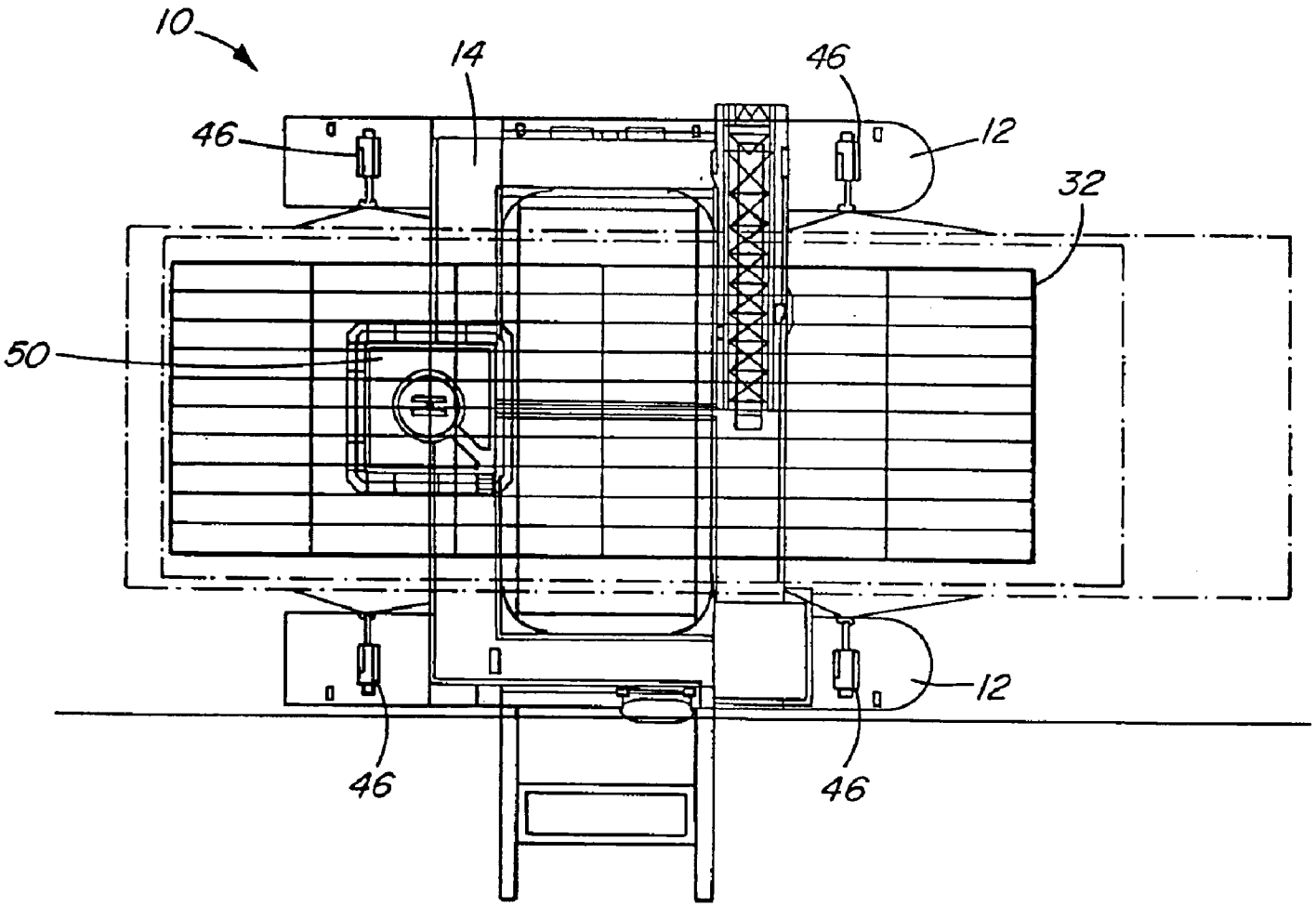
FIG. 4 is another plan view of the vessel of FIG. 1.

As shown in FIGS. 4 and 2, respectively, the pontoons 12 are spaced apart so that one large feeder barge 32 or two smaller barges 34 can be accommodated between the pontoons 12.

At its upper end, the marine leg 20 is capable of pivotal movement about an axis extending transversely of the pontoons 12 so that it can be raised or lowered relative to the barge 32,34 by means of luffing ropes operated by winches.

During an unloading operation, material (cargo) is scooped up and lifted by the marine leg 20 and transferred into a hopper travelling along with the trolley 22 that dumps the material onto the transfer conveyor 18.

A second lifting or elevating conveyor in the form of a high angle or C-loop conveyor 24 is provided for receiving material from the transfer conveyor 18 and for lifting the material to a level above the platform deck 14.

Figure 6:
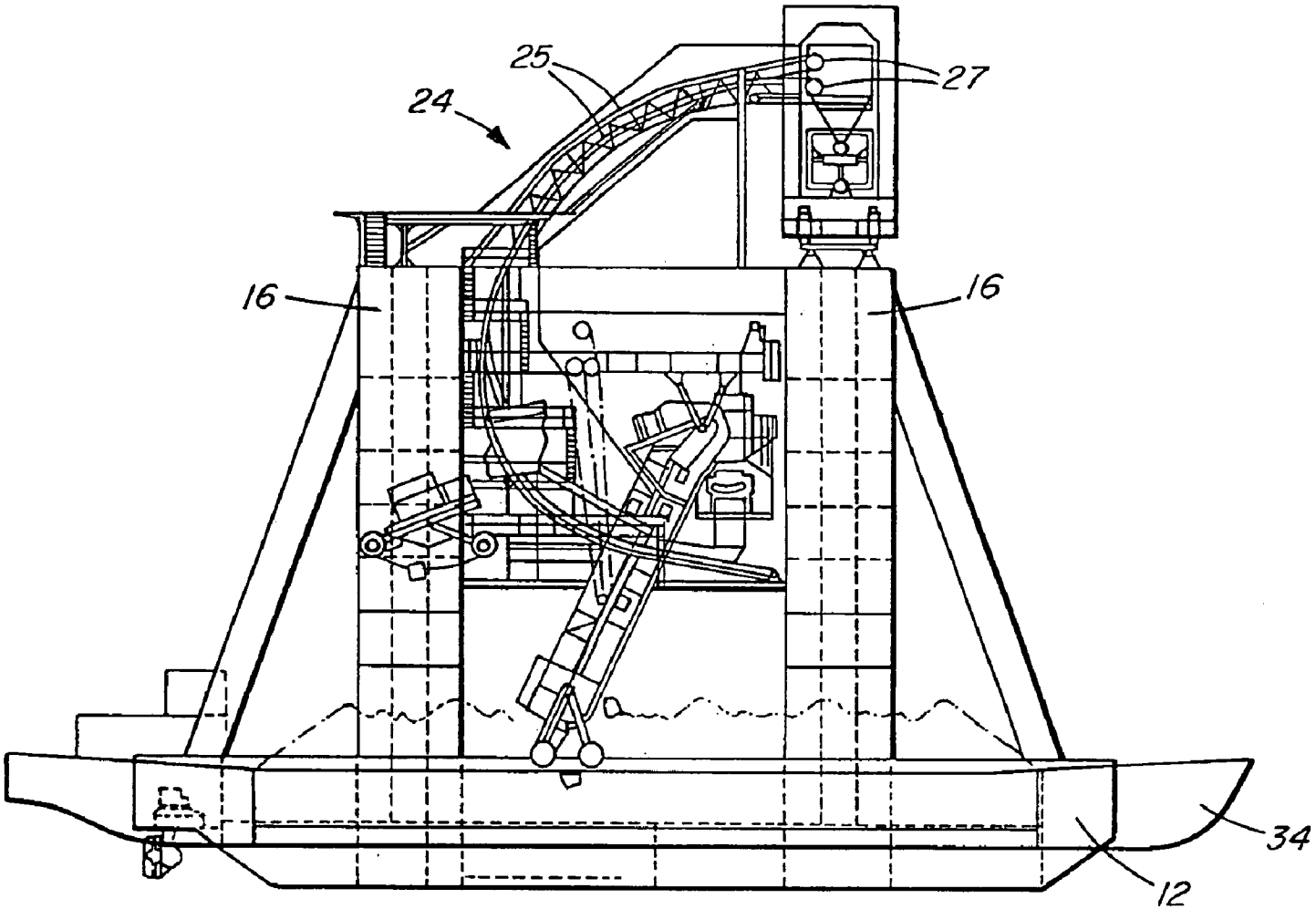
FIG. 6 is a side view of a transshipper showing detail of a marine leg and high angle conveyor on the transshipper.

As shown in FIG. 6, the conveyor 24 is in the form of a sandwich belt conveyor using a pair of endless belts 25 driven by motors 27.

An unloading boom 26 capable of luffing and slewing is provided for receiving material from the conveyor 24 and for delivering the material to a receiving vessel 28, such as a Cape or Panamax size vessel located alongside the vessel 10. As a result, the material is transferred from the holds or deck of the feeding barge 32, 34 to the holds of the vessel 28 in an uninterrupted bulk cargo transhipment operation.

In FIG. 1 the boom 26 is shown in an extended position for delivering material to a hold of the vessel 28 and in FIG. 2 the boom 26 is shown in a retracted or parked position. The boom 26 is in the latter position when the vessel 10 is travelling from one location to another.

The marine leg 20 is capable of unloading at a design rate of 3,000 tonnes per hour of coal or 4,000 tonnes per hour of iron ore during cream digging. Effective clean-out can be achieved with front-end loader assistance.

Figure 5:
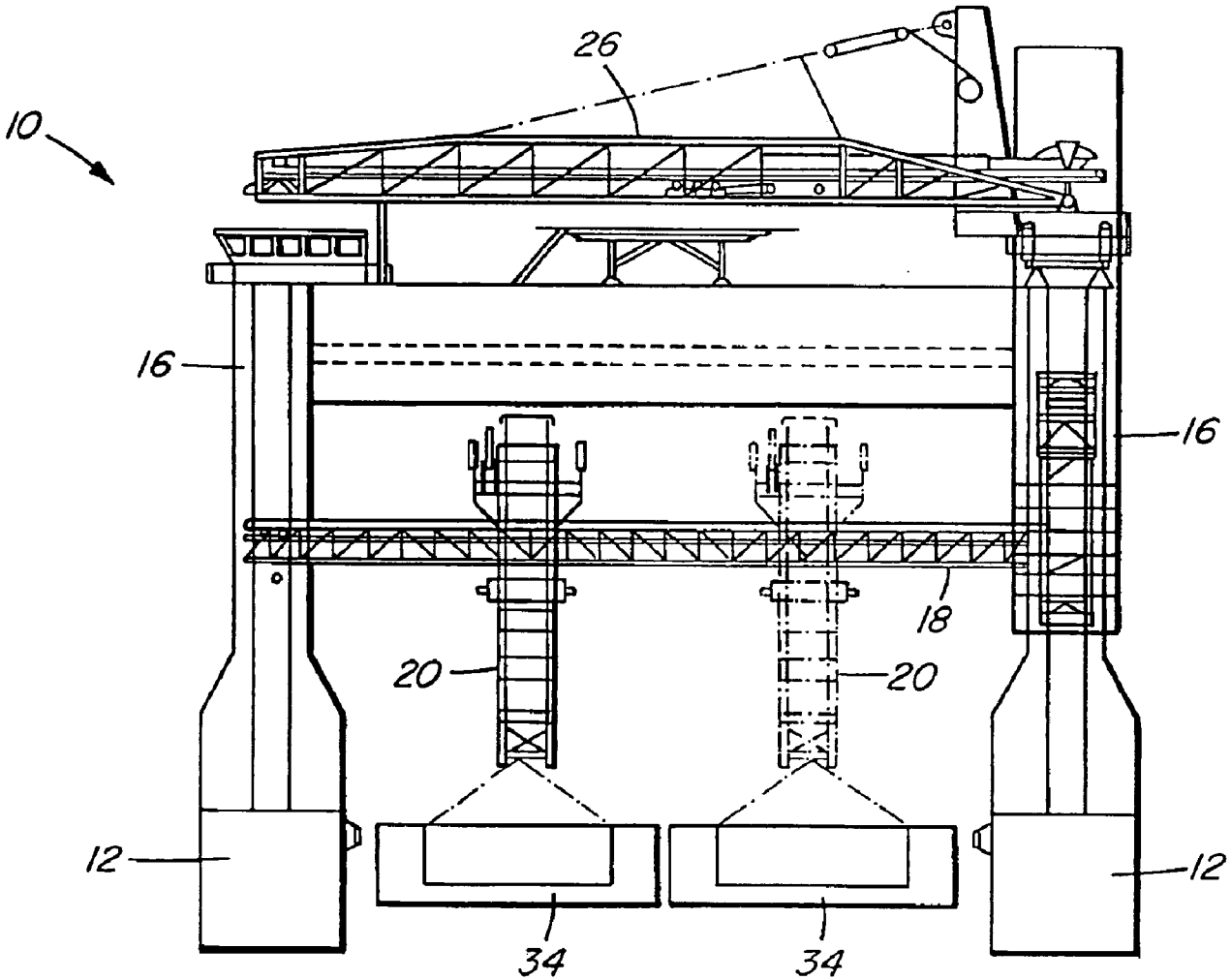
FIG. 5 is an end view of another catamaran transfer vessel.

In FIG. 2 the vessel 10 is shown provided with one marine leg 20. However, it may be provided with a pair of marine legs 20 as shown in FIG. 5. In this embodiment, a trolley 22 is provided for each marine leg 20 so that each marine leg 20 can be operated independently of the other for unloading the barges 32 simultaneously.

Figure 7:
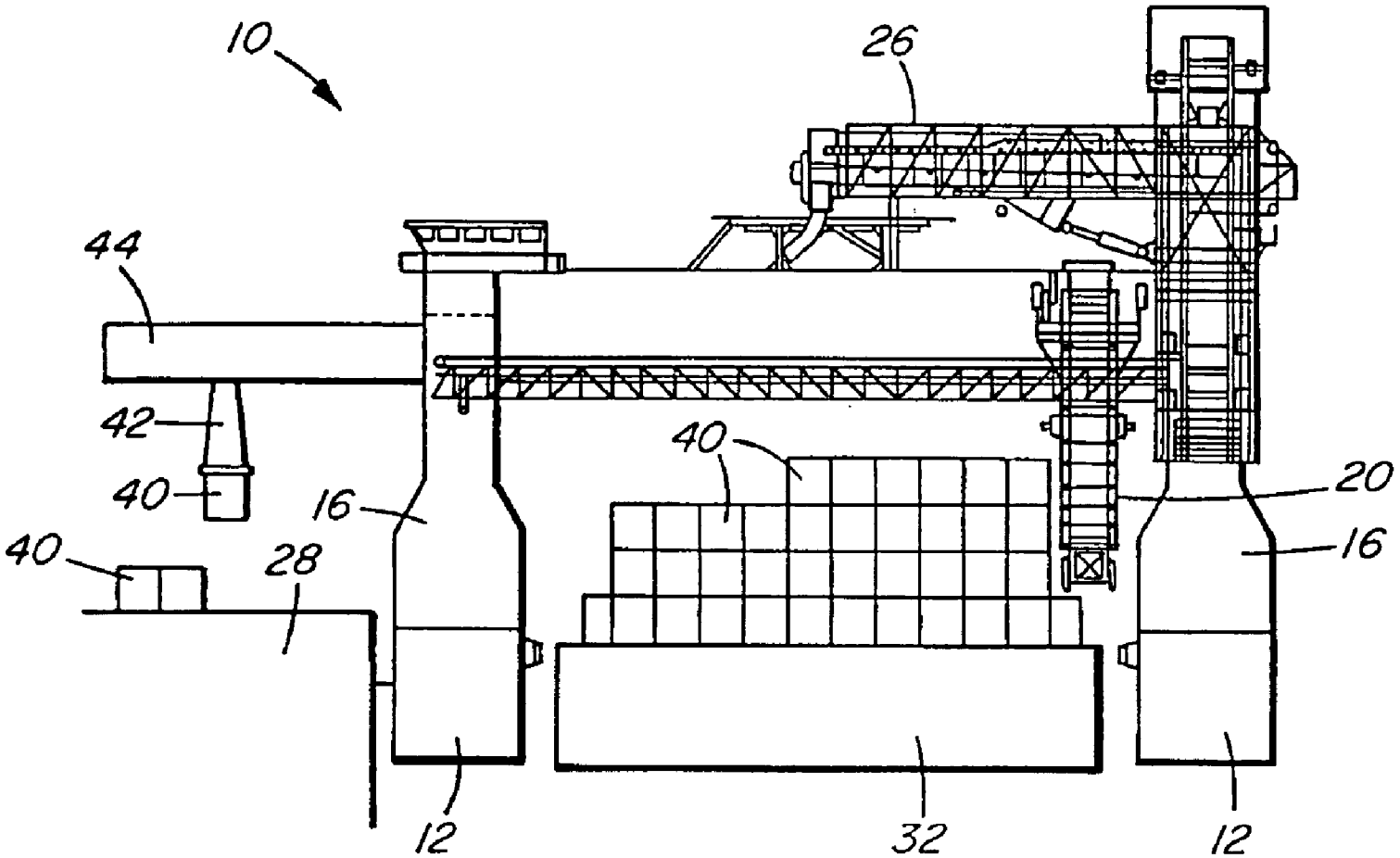
FIG. 7 is an end view of a transshipper in a container handling mode.

Apart from unloading particulate material, as referred to above, the vessel 10 can also be used for the transfer of containers 40. During a container transfer operation, the marine leg 20 is moved to one side of the vessel 10 (e.g. the starboard side), as shown in FIG. 7. A container handling trolley (not shown) is provided for transferring the containers 40 using a spreader 42. The container handling trolley is supported by a retractable gantry 44 which is extended over the opposite side (e.g. port side) of the vessel 10 for unloading the containers 40 onto the Cape/Panamax size vessel 28. The container handling trolley runs on rails extending transversely of the pontoons 12 and is traversed by a winch.

The vessel 10 is capable of unassisted manoeuvres along the length of ships and barges using an onboard system of constant-tension winches 46 and suitably configured thruster drives 30 and anchor handling equipment. As a result, the vessel 10 can take different unloading positions along the length of a feeder barge. The thrusters 30 enable the vessel 10 to move between transshipment sites and effectively station-keep during unloading operations as well as mooring.

The vessel 10 can accommodate crew members and facilitate all necessary marine operations independently at remote transhipment locations.

A helipad 50 is provided for easy access to remote transshipment locations.

The vessel 10 is also provided with a navigation bridge 52 which includes a cargo control centre from where the unloading operations can be controlled. A satellite communication system is also provided for data management and shore interface.

The barge 32 or barges 34 are maintained in position between the pontoons 12 by means of the constant tension winches 46.

The available spaces on board the vessel 10 are used for functional purposes, such as for machinery and equipment, storage, operations and living amenities. Dedicated ballast tanks are provided on both pontoons 12 to take care of boom compensation and any lists induced by unsymmetrical positions of the marine leg(s) 20.

Cross-pontoon access is facilitated by the provision of a separate and independent system of stairs and elevators in each column 16. The hulls of the pontoons 12 are constructed as fully watertight bodies. Operational access to different parts of the pontoons 12 is made possible through watertight doors provided on the vertical columns 16 and on deckhouses. In general, the vessel 10 is intended to be fully functional up to and including Sea State 5, whereas the ability to operate barges at this Sea State in a safe manner will determine the operating limits.

Although certain preferred embodiments of the present invention have been shown and described in detail, it should be understood that various changes and modifications may be made therein without departing from the scope of the appended claims.

I claim:

1. A transshipper for floating on water, comprising:

a pair of elongate buoyant vessels arranged in parallel spaced relationship for receiving a feeder barge to be unloaded between the vessels;

a platform supported by upright supports on the buoyant vessels in a raised position above the buoyant vessels;

a transfer conveyor supported by the buoyant vessels extending transversely of the buoyant vessels in a raised position above the buoyant vessels;

a first lifting conveyor suspended from the platform by means of a carriage which is movable relative to the platform in a direction longitudinally of the transfer conveyor for raising material to be unloaded from a feeder barge located between the buoyant vessels and depositing said material onto the transfer conveyor;

a second lifting conveyor mounted on the transshipper adjacent to the transfer conveyor for receiving the material from the transfer conveyor, the second lifting conveyor having a material discharge end located above the platform; and an unloading boom mounted on the platform and having a material receiving end located beneath the material discharge end of the second lifting conveyor for receiving the material from the second lifting conveyor and for delivering said material to a receiving vessel located alongside one of said buoyant vessels.

2. The transshipper according to claim 1, wherein a pair of said first lifting conveyors and a pair of said carriages are provided, each lifting conveyor being suspended from the platform by one of the carriages independently of the other lifting conveyor for independent operation of the lifting conveyors with respect to each other.

3. The transshipper according to claim 2, wherein a pair of feeder barges is received between the buoyant vessels, each of said lifting conveyors raising material from one of said barges independently of the other lifting conveyor.

4. The transshipper according to claim 1, wherein said first lifting conveyor comprises a bucket elevator.

5. The transshipper according to claim 1, further comprising a plurality of constant tension winches for moving the transshipper to different unloading positions along the length of a feeder barge.

6. The transshipper according to claim 1, further comprising:

a retractable gantry supported by the platform in a raised position above the buoyant vessels, the gantry extending transversely of the buoyant vessels; and a container handling device suspended from the gantry for lifting containers from a feeding barge and moving said containers onto a receiving vessel.

* * * * *